US008534785B2

(12) United States Patent
Asami

(10) Patent No.: US 8,534,785 B2
(45) Date of Patent: Sep. 17, 2013

(54) INKJET PRINTER

(75) Inventor: Keiichi Asami, Tokyo (JP)

(73) Assignee: Riso Kagaku Corporation, Tokyo (JP)

( * ) Notice: Subject to any disclaimer, the term of this patent is extended or adjusted under 35 U.S.C. 154(b) by 85 days.

(21) Appl. No.: 13/358,774

(22) Filed: Jan. 26, 2012

(65) Prior Publication Data

US 2012/0268507 A1 Oct. 25, 2012

(30) Foreign Application Priority Data

Apr. 19, 2011 (JP) ..... 2011-093233

(51) Int. Cl.
*B41J 29/38* (2006.01)

(52) U.S. Cl.
USPC ..... 347/6; 347/14; 347/19

(58) Field of Classification Search
USPC ..... 347/5, 6, 7, 14, 19, 84–87, 89
See application file for complete search history.

(56) References Cited

U.S. PATENT DOCUMENTS 6,443,560 B1 9/2002 Okano et al.
7,845,784 B2 * 12/2010 Nitta et al. ..... 347/89

FOREIGN PATENT DOCUMENTS

JP 2001-219580 A 8/2001

* cited by examiner

*Primary Examiner* — Juanita D Jackson
(74) *Attorney, Agent, or Firm* — Holtz, Holtz, Goodman & Chick, PC

(57) ABSTRACT

An inkjet printer includes an ink circulation path, a first tank, a second tank, and a pump, first and second liquid surface detectors which respectively detect ink liquid surfaces in the first and second tanks, an ink supply unit, a supplementary feed valve a control unit, a storage unit, and a determination unit. During ink circulation, the storage unit accumulatively stores a detection result of the second detector. Based on the result, the determination unit determines occurrence of an abnormality in the second liquid surface detector. The storage unit thereafter accumulatively stores the detection result. Based on the result, the determination unit determines occurrence of the first liquid surface detector.

7 Claims, 8 Drawing Sheets

| | | State of second liquid surface detector 43 | |
|---|---|---|---|
| | | ON 61 | OFF 62 |
| State of first liquid surface detector 42 | ON | Pump 30 OFF<br>Supplementary feed valve 19 OFF | Pump 30 OFF<br>Supplementary feed valve 19 OFF |
| | OFF | Pump 30 ON<br>Supplementary feed valve 19 OFF | Pump 30 OFF<br>Supplementary feed valve 19 ON |
| | | 63 | 64 |

F I G. 3A

| | | State of second liquid surface detector 43 | |
|---|---|---|---|
| | | ON 65 | OFF 62 |
| State of first liquid surface detector 42 | ON | Pump 30<br>State maintenance<br>Supplementary feed valve 19 OFF | Pump 30 OFF<br>Supplementary feed valve 19 OFF |
| | OFF | Pump 30 ON<br>Supplementary feed valve 19 OFF | Pump 30 OFF<br>Supplementary feed valve 19 ON |
| | | 63 | 64 |

F I G. 3B

| | | State of second liquid surface detector 43 | |
|---|---|---|---|
| | | ON 61 | OFF 62 |
| State of first liquid surface detector 42 | ON | Pump 30 OFF<br>Supplementary feed valve 19 OFF | Pump 30 OFF<br>Supplementary feed valve 19 OFF |
| | OFF | Pump 30 ON<br>Supplementary feed valve 19 OFF | Pump 30<br>State maintenance<br>Supplementary feed valve 19 ON |
| | | 63 | 66 |

F I G. 3C

INKJET PRINTER

CROSS-REFERENCE TO RELATED APPLICATIONS

This application is based upon and claims the benefit of priority from prior Japanese Patent Application No. 2011-093233, filed Apr. 19, 2011, the entire contents of which are incorporated herein by reference.

BACKGROUND OF THE INVENTION

1. Field of the Invention

The present invention relates to an inkjet printer comprising an ink circulation path.

2. Description of the Related Art

An inkjet printer which records images by ejecting inks to recording media from an inkjet head is widely used. As an example of such an inkjet printer, there is a known printer comprising an ink circulation path which circulates an ink between an ink tank storing an ink and an inkjet head.

For example, Jpn. Pat. Appln. KOKAI Publication No. 2001-219580 Publication discloses an inkjet printer comprising an ink circulation path which comprises: a recording head (inkjet head); a first ink tank provided above the recording head; and a second ink tank provided below the recording head; and a pump which pumps the ink from the second ink tank to the first ink tank. On this ink circulation path, image recording is performed while the ink is circulated through the ink circulation path by supplying an ink from the first ink tank to the second ink tank through the recording head utilizing height differences between positions of the first ink tank, the recording head, and the second ink tank and by drawing up the ink collected into the second ink tank further into the first ink tank by the pump.

Further, the inkjet printer according to Jpn. Pat. Appln. KOKAI Publication No. 2001-219580 is provided with a liquid surface detector which detects an ink liquid surface inside each of the first and second ink tanks. These liquid surface detectors monitor ink surfaces in the first and second ink tanks, and output signals from the liquid surface detectors are transferred to a control unit. If the ink in the first ink tank is determined to be insufficient by the output signal from the liquid surface detector for the first ink tank, the ink is suctioned from the second ink tank to the first ink tank to supply the first ink tank with the ink. Further, if an ink in the second ink tank is determined to be insufficient by the output signal from the liquid surface detector for the second ink tank, the second ink tank is supplied with the ink from a supply ink tank. Thus, even when the ink is ejected from the recording head during circulation of the ink, an amount of the ink in the ink circulation path is maintained properly.

Meanwhile, the inkjet printer described in the publication No. 2001-219580 is based on a prerequisite that the liquid surface detectors provided respectively for the first and second ink tanks operate properly. However, the liquid surface detectors can cause a malfunction or operation error due to external disturbance factors. In this case, a proper ink circulation operation and ink charging operation as described above cannot be achieved through the ink circulation path. For example, even when sufficient ink remains in an ink tank, the ink can possibly be determined to be short. Consequently, an excessive portion of the ink over a capacity flows in and overflows to outside the tank, thereby staining inside of the printer.

Therefore, there is a need to detect whether the liquid surface detectors properly operate or not. However, the publication No. 2001-219580 discloses nothing about detection of whether the liquid surface detectors properly operate or not.

BRIEF SUMMARY OF THE INVENTION

The present invention is directed to providing an inkjet printer capable of achieving a proper ink circulation operation by detecting malfunctions and operation errors in a liquid surface detector which detects an ink liquid surface in an ink tank.

According to a embodiment of the invention, an inkjet printer is provided, the inkjet printer comprising: an ink circulation path comprising an ink head comprising a nozzle surface where a plurality of nozzles which eject an ink are formed, a first tank which is positioned above the nozzle surface along a gravitational direction and stores the ink to be supplied for the ink head, a second tank which is provided below the nozzle surface in the gravitational direction and stores the ink collected from the ink head, a pump which pumps the ink from the second tank to the first tank; first and second liquid surface detectors which respectively detect ink liquid surfaces in the first and second tanks; an ink supply unit which supplies the ink circulation path with the ink; a supplementary feed valve which makes the ink supply unit and the ink circulation path communicate with or shut from each other; a control unit which controls driving and a stop operation of the pump, an open/close operation of the supplementary feed valve, and the whole inkjet printer; a storage unit which stores information detected by the first and second liquid surface detectors; and a determination unit which determines whether or not an abnormality occurs in the first and second liquid surface detectors, based on the information, wherein when the ink circulates through the ink circulation path, the second liquid surface detector detects whether or not the ink liquid surface in the second tank is higher than a predetermined level, the detected information is accumulatively stored into the storage unit, the determination unit determines whether or not an abnormality occurs in the second liquid surface detector, based on the accumulatively stored information, the first liquid detector thereafter detects whether or not an ink liquid surface in the first tank is higher than a predetermined level, the detected information is accumulatively stored into the storage unit, and the determination unit determines whether or not an abnormality occurs in the first liquid surface detector, based on the accumulatively stored information.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate embodiments of the invention, and together with the general description given above and the detailed description of the embodiments given below, serve to explain the principles of the invention.

FIG. 3A is a transition table showing a first mode of operations of a pump and a supplementary feed valve;

FIG. 3B is a transition table showing a second mode of operations of the pump and supplementary feed valve;

FIG. 3C is a transition table showing a third mode of operations of the pump and supplementary feed valve;

DETAILED DESCRIPTION OF THE INVENTION

Hereinafter, an embodiment of the invention will be described.

Figure 1:
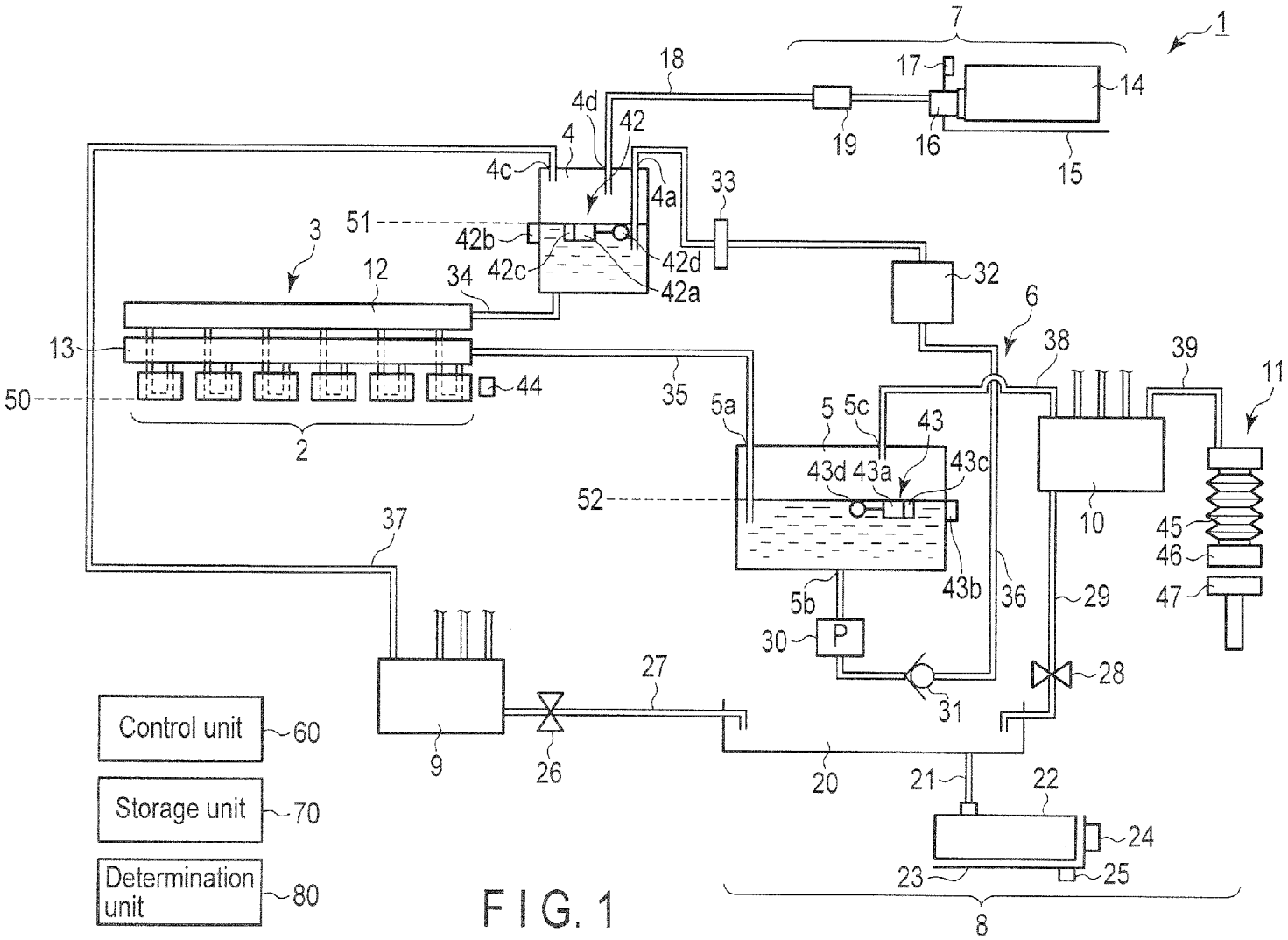
FIG. 1 schematically shows a configuration of an ink path in an inkjet printer.

FIG. 1 schematically shows a configuration of an ink path 1 in an inkjet printer according to an embodiment of the invention. Although FIG. 1 typically shows only a configuration of an ink path concerning an ink of a color, the inkjet printer comprises ink paths for four colors of inks, such as, cyan (C), black (K), magenta (M), and yellow (Y).

In addition to an ink path 1 shown in FIG. 1, the inkjet printer has the same configuration as a conventional inkjet printer, such a supply unit which supplies recording media, a conveyor unit which conveys the supplied recording media, a discharge unit which feeds out the recording media with an image recorded on and a maintenance unit which performs a maintenance operation for an ink head.

Where roughly divided, the ink path 1 comprises: an image recording unit 3 comprising a plurality of ink heads 2; an ink circulation unit 6 which comprises at least a first tank 4 and a second tank 5 and circulates an ink for the image recording unit 3; a supply unit 7 which supplies the ink circulation unit 6 with the ink; a drainage unit 8 to contain an unrequired ink and an overflowing ink; a first-tank-shared air chamber 9 and a second-tank-shared air chamber 10; and a pressure adjuster 11. For example, when the inkjet printer comprises ink paths for four colors of inks, the inkjet printer comprises four independent systems of ink paths (ink circulation units) and image recording units. However, the drainage unit 8, first-tank-shared air chamber 9, second-tank-shared air chamber 10 and pressure adjuster 11 are common to all of these colors.

The inkjet printer also comprises: a control unit 60 which performs control of a whole printer, such as an image recording operation of the image recording unit 3; a storage unit 70 such as a program memory in form of a RPM which stores required control programs or a data memory in form of a RAM which stores information output from individuals of components forming the inkjet printer; and a determination unit 80 which makes a determination for controlling the individual components of the inkjet printer, based on information stored in the storage unit 70.

The image recording unit 3 will be described first.

The image recording unit 3 comprises a plurality of ink heads 2, an ink distributor 12 to distribute an ink to the plurality of ink heads 2, and an ink collector 13 to collect the ink from the plurality of ink heads 2. The ink distributer 12 is connected to communicate with the plurality of ink heads 2 and the first tank 4. The ink collector 13 is connected to communicate with the plurality of ink heads 2 and the second tank 5.

In the present embodiment, the ink distributer 12 is provided in an upstream side of the ink heads 2, and the ink collector 13 is provided in a downstream side thereof. However, the first tank 4 and second tank 5 are not limited to this configuration but may be connected directly to the ink heads 2.

In the present embodiment, the plurality of short ink heads 2 which are shorter in width than a width (recording width) of a recording medium are arrayed, for example, in a zigzag layout along a width direction of the recording medium (perpendicular to a conveying direction of the recording medium), thereby to form a line head wider than the recording width. The embodiment is not limited to these ink heads but may employ a long ink head.

In a nozzle surface 50 of each ink head 2, a plurality of nozzles are formed in columns. The ink heads 2 each are internally maintained at a negative pressure (approximately −1 kPa at a gauge pressure in the present embodiment) during ink circulation, which creates a spherically concave meniscus inside each nozzle, to enable a proper recording operation. During recording, the ink heads 2 each eject the ink from the nozzles to a recording medium which is conveyed by a conveyor unit not shown, based on an image signal input from outside. In this manner, a desired image is recorded on the recording medium.

Next, the supply unit 7 will be described.

The supply unit 7 comprises: an ink cartridge 14 filled with a refill ink; an ink cartridge tray 15 on which the ink cartridge 14 is arranged; a joint unit 16 detachably connected to a supply port of the ink cartridge 14; an ink cartridge determination unit 17 for preventing the ink cartridge 14 from being erroneously attached and for detecting a residual ink amount; and a supplementary feed valve 19 which is interposed in a tube 18 connected from the joint, unit 16 to the first tank 4 and makes the supply unit 7 and ink circulation unit 6 to communicate with or shut from each other.

In the present embodiment, the supply unit 7 is connected to the first tank 4 through a tube 18. However, the supply unit 7 may alternatively be connected to the second tank 5. In this case, the second tank 5 is supplied with the ink from the supply unit 7.

Next, the drainage unit 8 and the first- and second-tank-shared air chambers 9 and 10 will be described.

The drainage unit 8 comprises: an overflow tank 20 which collects an (overflow) ink overflowing from the ink circulation unit 6; a drainage tank 22 which is detachably coupled to the overflow tank 20 through a tube 21; a drainage tank tray 23 on which the drainage tank 22 is arranged; a drainage amount detector 24 which detects an amount of ink contained in the drainage tank 22, from a difference in weight or liquid levels; and a drainage-tank attachment detector 25 which detects presence or absence of mounting of the drainage tank 22 by optical detection.

The overflow tank 20 is provided below the pump 30 so as to receive all of an overflowing ink even when the pump 30 described later is damaged and an ink overflows from the ink circulation unit 6. Further, the overflow tank 20 is connected to the first-tank-shared air chamber 9 through a tube 27 with an air release valve 26 interposed therebetween, as well as connected to the second-tank-shared air chamber 10 through a tube 29 with an air release valve 28 interposed therebetween. Further, the first-tank-shared air chamber 9 is connected to the first tank 4 through a tube 37, and the second-tank-shared air chamber 10 is connected to the second tank 5 by a tube 38.

The configuration as described above allows an overflowing ink to be collected into the overflow tank 20 through the tube 37, the first-tank-shared air chamber 9 and tube 27 from the first tank 4, as well as through the tube 38, the second-tank-shared air chamber 10 and tube 29 from the second tank 5, even when an ink overflows from the first tank 4 or second tank 5. The ink thus contained in the overflow tank 20 is further collected into the drainage tank 22 through the tube 21.

Since the tube 27 extended from the first-tank-shared air chamber 9 is inserted into the overflow tank 20 through the air release valve 26, the first-tank-shared air chamber 9 can be opened/closed to the air by opening/closing (releasing/shutting) the air release valve 26. Similarly, the tube 29 extended from the second-tank-shared air chamber 10 is inserted into the overflow tank 20 through the air release valve 28, the second-tank-shared air chamber 10 can be opened/closed to the air by opening/closing (releasing/shutting) the air release valve 28. That is, the air release valve 26 allows inside of the first tank 4 to communicate with or shut from the air. The air release valve 28 allows inside of the second tank 5 to communicate with or shut from the air.

Next, the ink circulation unit 6 will be described.

The ink circulation unit 6 comprises the first tank 4, second tank 5, pump 30, a one-way valve 31, a heat exchanger 32 and a filter 33. As for these components, nozzle surfaces 50 of the ink head 2, an ink liquid surface 51 inside the first tank 4 and an ink liquid surface 52 inside the second tank 5 are arranged so as to satisfy a positional relationship that the ink liquid surface 51, nozzle surfaces 50, and ink liquid surface 52 are positioned in this order from the highest position to the lowest position along a perpendicular direction (gravitational direction). The ink circulation unit 6 comprises an ink circulation path which allows the ink to flow from the first tank 4 and return to the first tank 4, orderly through the ink distributer 12, ink heads 2, ink collector 13, second tank 5, pump 30, one-way valve 31, heat exchanger 32, and filter 33, connected to one another by tubes 34 to 36.

Figure 2:
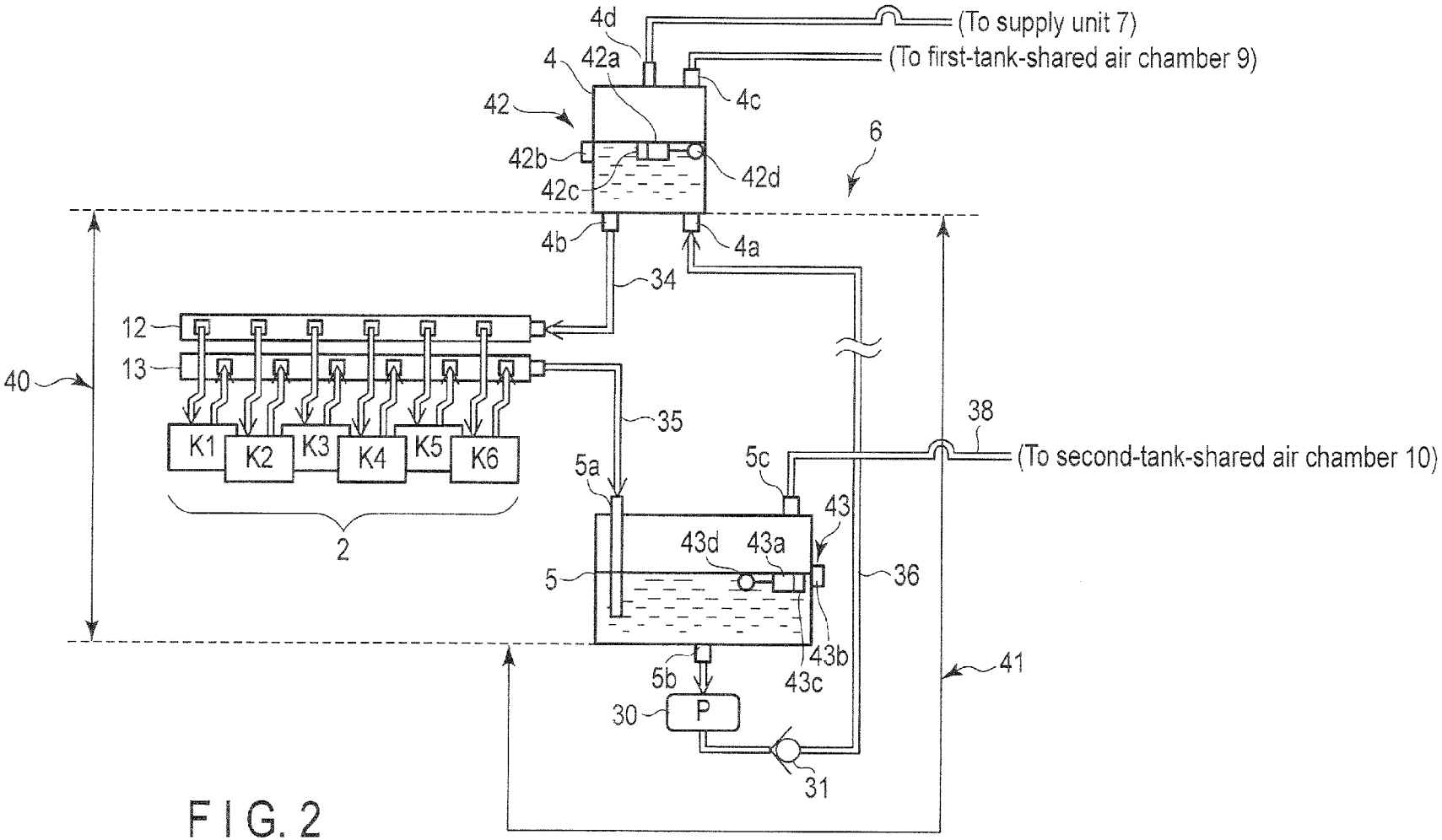
FIG. 2 schematically shows the configuration of the ink circulation unit.

FIG. 2 schematically shows an enlarged view of the configuration of the ink circulation unit 6 in FIG. 1. Arrows added to the tubes 34 to 36 in FIG. 2 indicate directions in which the ink flows when the ink circulates through the ink circulation path. The heat exchanger 32 and filter 33 are omitted from FIG. 2.

The ink circulation unit 6 according to the present embodiment is divided into a first path 40 and a second path 41, as shown in FIG. 2. The first path 40 is to flow the ink from the first tank 4 to the second tank 5 through the ink heads 2. The second path 41 is to flow the ink up from the second tank 5 to the first tank 4 through the one-way valve 31, heat exchanger 32 and filter 33 by the pump 30.

At first, components of the first path 40 will be described in details.

The first tank 4 stores an ink to be supplied for the ink heads 2. The first tank 4 is provided with an ink inlet port 4*a*, an ink outlet port 4*b*, an air port 4*c* and an ink supply port 4*d*.

The ink inlet, port 4*a* is connected to the filter 33 through the tube 36, and makes the ink, which flows out of the filter 33, flow into the first tank 4. An opening of the ink inlet port 4*a* in the first tank 4 is provided to be lower (see FIG. 1 and at a bottom of the first tank 4 in FIG. 2) than the ink liquid surface in the first tank 4 along the perpendicular direction (gravitational direction) so that air bubbles may not be mixed into the ink flowing in.

The ink outlet port 4*b* is connected to the ink distributer 12 through the tube 34, and makes the ink flow from the first tank 4 to the ink distributer 12. The ink which has flowed into the ink distributer 12 is distributed evenly to the ink heads 2 (K1 to K6). The ink which has flowed into the ink heads 2 is ejected through nozzles formed in the nozzle surfaces 50 of the ink heads 2. In this manner, an image is recorded on a recording medium conveyed by the conveyor unit not shown.

An amount of ink which flows into the ink heads 2 is set to be greater than an amount of the ink ejected from the nozzles. Therefore, a portion of the ink which is not ejected from the nozzles is once collected by the ink collector 13, and then flows out to the second tank 5 through the tube 35.

The air port 4*c* is connected to the first-tank-shared air chamber 9 through the tube 37. The first-tank-shared air chamber 9 is connected also to air ports of first tanks 4 for the other colors.

The ink supply port 4*d* is connected to the ink cartridge 14 through the tube 18. In the present embodiment, the ink is supplied to the first tank 4 from the ink cartridge 14 due to differences in height therebetween by opening the supplementary feed valve 19. However, the embodiment is not limited hitherto but the ink needs only to be fed from the ink cartridge 14 to the first tank 4. For example, the ink may be fed by a pump in place of the supplementary feed valve 19.

Further, in order to maintain an ink liquid surface at a predetermined height, that is, to maintain an ink in the first tank 4 at a predetermined amount, the first tank 4 is provided with a first liquid surface detector 42 which detects whether or not the ink liquid surface in the first tank 4 is at a predetermined level or higher.

The first liquid surface detector 42 comprises: a float member 42*a* which is floated on the ink liquid surface; a liquid surface position sensor 42*b* attached to a wall surface of the first tank 4; and a magnet 42*c* which is attached to the float member 42*a*.

The float member 42*a* is pivotally supported by a support shaft 42*d* so as to be pivotal depending on the height of the ink liquid surface in the first tank 4. The liquid surface position sensor 42*b* is made of, for example, a magnetic sensor, and detects the position of the float member 42*a*, that is, the height of the ink liquid surface in the first tank 4 by detecting magnetic force of the magnet 42*c* attached to the float member 42*a*. Further, whether an ink amount in the first tank 4 is proper or not is determined, based on a liquid surface detection signal detected by the first liquid surface detector 42. Further, the control unit 60 controls drive and stop operations of the pump 30 and an open/close operation of the supplementary feed valve 19. Thus, the ink amount in the first tank 4 is maintained at a predetermined amount.

The second tank 5 stores an ink collected from the ink heads 2. The second tank 5 is provided with: an ink inlet port 5*a* which is connected to the ink collector 13 through the tube 35 and allows the ink to flow in from the ink collector 13; an ink outlet port 5*b* which is connected to the pump 30 through the tube 36 and feeds the ink to the pump 30; and an air port 5*c* which is connected to the second-tank-shared air chamber 10 through the tube 38.

Further, in order to maintain an ink liquid surface at a predetermined height, the second tank 5 is provided with a second liquid surface detector 43 which detects whether or not the ink liquid surface in the second tank 5 is lower than a predetermined level. Similarly to the first liquid surface detector 42, the second liquid surface detector 43 comprises a float member 43*a*, a liquid surface position sensor 43*b*, and a magnet 43*c* attached to the float member 43*a*. These components have the same configuration as the first liquid surface detector 42, and therefore, descriptions thereof will be omitted herefrom.

In the present embodiment, the first and second liquid surface detectors 42 and 43 are magnetic sensors. However, the embodiment is not limited hitherto but may employ optical sensors each comprising a light emitting element and a light receiving element.

Next, constitutive components of the second path 41 will be described in details.

For example, an electromagnetic piston pump may be used as the pump 30. The pump 30 is driven/stopped to feed the ink from the second tank to the first tank by the control unit 60 in accordance with detection results of the first liquid surface detector 42 and second liquid surface detector 43, in a manner that heights of the ink liquid surface 51 and ink liquid surface 52 are respectively maintained within desired ranges in the first, tank 4 and second tank 5.

Also in the present embodiment, liquid feed capability of the pump 30 is designed to be able to feed into the first tank 4 an amount of ink which is greater than that flowing into the second tank 5. This design is to prevent overflow from the second tank 5. That is, in ordinary use, overflow from the second tank 5 is prevented by increasing a flow rate of the ink, at which the pump 30 can feed up when the pump 30 is driven, to be greater than a flow rate of the ink which flows into the second tank 5.

Although the present embodiment employs an electromagnetic piston pump as the pump 30, the pump 30 needs ability only to be able to feed a greater amount of ink than an amount of ink flowing into the second tank 5. For example, a diaphragm pump, gear pump, tube pump, rotary pump, or centrifugal pump which has such a feeding ability may be used.

The one-way valve 31 is interposed in the tube 36 in an ink ejection side (a path in a liquid feed side toward the first tank 4) of the pump 30. The one-way valve 31 prevents reverse flow of ink or, specifically, flow of ink toward the second tank 5 from the first tank 4, which is caused by a difference in height between the ink liquid surface 51 in the first tank 4 and the ink liquid surface 52 in the second tank 5.

That is, as described above, the liquid feed capability of the pump 30 is set to be able to feed up a greater amount of ink than an amount of ink which flows form the first tank 4 to the second tank 5 through the ink heads 2. Therefore, when an ink circulation operation is performed, the pump 30 performs an intermittent operation. When the pump 30 stops, the ink reversely flows from the first tank 4 to the second tank 5. Therefore, the one-way valve 31 prevents this reverse flow.

The heat exchanger 32 comprises a heat sink unit, a cooling fan, a heater unit and an ink flow path. The configuration as described except the ink flow path is common to the ink paths for all colors. The heat exchanger 32 functions to control the temperature of the ink which flows inside the ink circulation unit 6 to a desired temperature. In order to control the heat exchanger 32 by detecting the temperature of the ink, each of the ink heads 2 or the ink flow path near the ink heads 2 is provided with a temperature sensor 44 as shown in FIG. 1.

The filter 33 is provided to remove foreign materials contained in the ink supplied for the ink heads 2 and to eliminate recording errors caused by clogging of nozzle holes. The filter 33 comprises meshed member to allow the ink to penetrate. In order to allow the ink to pass a diameter of each nozzle hole of the ink heads 2, a mesh having a mesh size is so selected as to remove sufficiently small foreign materials.

Next, the pressure adjuster 11 will be described with reference to FIG. 1.

The pressure adjuster 11 comprises a bellows unit 45 which generates a negative pressure, a weight unit 46, and a bellows elevation mechanism 47.

The bellows unit 45 is connected to the second-tank-shared air chamber 10 by the tube 39. As the bellows unit 45 extends and drops due to a load of the weight unit 46 with the air release valve 28 shut off from the air, inside of the second-tank-shared air chamber 10 is put in a state of a negative pressure. That is, when the air release valve 28 is closed to drop the bellows elevation mechanism 47 to a position as shown in FIG. 1, the bellows unit 45 which is apart from the bellows elevation mechanism 47 is pulled down by a weight of the weight unit 46. Accordingly, a negative pressure is generated in the second-tank-shared air chamber 10 in balance with the gravity acting on the weight unit 46.

Further, the same negative pressure as generated in the second-tank-shared air chamber 10 is generated in the second tank 5 connected to the second-tank-shared air chamber 10 through the tube 38. The negative pressure in the second tank 5 is arranged so as to apply a pressure adequate for recording (for example, a nozzle pressure of approximately −1 kPa during ink circulation) to inside of the ink heads 2 which communicates through the tube 35 during ink circulation, or more specifically, to inside of the ink heads 2 near the nozzles. By this pressure, a meniscus is formed in each nozzle.

A standby position of the bellows elevation mechanism 47 is arranged such that the bellows unit 45 shrinks and a negative pressure can be generated in a short time when ink circulation is performed. In addition, a partition wall (not shown), only an upper part of which communicates, is provided inside the second-tank-shared air chamber 10 so that the ink in the second tank 5 may not enter into the pressure adjuster 11 even when the ink overflows. In this manner, only transfer of a gas is performed inside the tube 39 which communicates from the second tank 5 to the pressure adjuster 11.

Next, with reference to FIGS. 3A to 3C, operations of the pump 30 and supplementary feed valve 19 will be described under each state (on or off) detected by the first liquid surface detector 42 of the first tank 4 and the second liquid surface detector 43 of the second tank 5.

In transition tables shown in FIGS. 3A, to 3C, an on-state of the liquid surface detector 42 indicates a state in which the ink liquid surface in the first tank 4 has reached a desired level (height) (i.e., a desired amount of ink is stored in the first tank 4) and the first liquid surface detector 42 outputs on. Similarly, an on-state of the liquid surface detector 43 indicates a state in which the ink liquid surface in the second tank 5 has reached a desired level (height) (i.e., a desired amount of ink is stored in the second tank 5) and the second liquid surface detector 43 outputs on.

The off-state of the first liquid surface detector 42 indicates a state in which the ink liquid surface in the first tank 4 has not vet reached the desired level (i.e., the desired amount of ink is not stored in the first tank 4) and the first liquid surface detector 42 outputs off. Similarly, an off-state of the liquid surface detector 43 indicates a state in which the ink liquid surface in the second tank 5 has not yet reached the desired level (i.e., the desired amount of ink is stored in the second tank 5) and the second liquid surface detector 43 outputs off.

In descriptions below, a state of outputting on from the first liquid surface detector 42 or the second liquid surface detector 43 will be simply referred to as "on", and a state of outputting off will be simply referred to as "off".

Further, an off-state of the pump 30 indicates a state in which the pump 30 stops, and an on-state of the pump 30 indicates a state in which the pump 30 drives. Further, an off-state of the supplementary feed valve 19 indicates a state in which the supplementary feed valve 19 is closed and no ink is supplied into the first tank 4. Inversely, an on-state of the supplementary feed valve 19 indicates a state in which the supplementary feed valve 19 is opened and an ink is supplied from the ink cartridge 14 into the first tank 4.

FIG. 3A is a transition table showing a first mode of operations of the pump 30 and supplementary feed valve 19 during ink circulation. In the first mode, the pump 30 and supplementary feed valve 19 are controlled to both be off regardless of whether the second liquid surface detector 43 is on (first state 61) or off (second state 62), when the first liquid surface detector 42 is on. That is, when the first liquid surface detector 42 detects the first tank 4 as containing sufficient ink, any ink is neither fed upward to the first tank 4 from the second tank 5 nor supplied from the ink cartridge 14 to the first tank 4 regardless of the amount of the ink in the second tank 5.

When the first liquid surface detector 42 is off and the second liquid surface detector 43 is on (third state 63), the pump 30 and supplementary feed valve 19 are respectively controlled to be on and off. That is, when the first liquid surface detector 42 detects the first tank 4 as containing sufficient ink and the second liquid surface detector 43 also detects the second tank 5 as containing sufficient ink, an ink is fed upward to the first tank 4 from the second tank 5 while no ink is supplied from the ink cartridge 14 to the first tank 4.

Further, when the first liquid surface detector 42 is off and the second liquid surface detector 43 is also off (fourth state 64), the pump 30 and supplementary feed valve 19 are respectively controlled to be off and on. That is, when the first liquid surface detector 42 detects the first tank 4 as not containing sufficient ink and the second liquid surface detector 43 also detects the second tank 5 as not containing sufficient ink, an ink is not fed upward to the first tank 4 from the second tank 5 while an ink is supplied from the ink cartridge 14 to the first tank 4.

Accordingly, the pump 30 is on only when the first liquid surface detector 42 is off and the second liquid surface detector 43 is on (third state 63). The supplementary feed valve 19 is on only when the first liquid surface detector 42 is off and the second liquid surface detector 43 is also off (fourth state 64).

FIG. 3B is a transition table showing a second mode of operations of the pump 30 and supplementary feed valve 19 during ink circulation. The second mode differs from FIG. 3A when the liquid surface detector 42 is on and the second liquid surface detector 43 is also on. That is, in FIG. 3B, when the first liquid surface detector 42 is on and the second liquid surface detector 43 is also on, control is performed so as to transit to a fifth state 65 in which the supplementary feed valve 19 is off and the pump 30 is maintained to drive or stop (state maintenance control).

"State maintenance" means that an operation of the pump 30 before the transition to the fifth state 65 is continued. For example, when the pump 30 is on and the liquid surface detectors are both on, the supplementary feed valve 19 is off as shown in FIG. 3A. However, the pump 30 is continuously controlled to be kept on. When the pump 30 is off and the liquid surface detectors are both on, the supplementary feed valve 19 and pump 30 are controlled to be off and continuously off, respectively. That is, the second mode implies that the pump 30 is stopped only when the second liquid surface detector 43 is off.

FIG. 3C is a transition table showing a third mode of operations of the pump 30 and supplementary feed valve 19 during ink circulation. The third mode differs from FIG. 3A when the first liquid surface detector 42 is off and the second liquid surface detector 43 is also off. That is, in FIG. 3C, when the first liquid surface detector 42 is off and the second liquid surface detector 43 is also off, control is performed so as to transit to a sixth state 66 in which the supplementary feed valve 19 is on and pump 30 is maintained to drive or stop (state maintenance control).

For example, when the operation of the pump 30 is on and the liquid surface detectors are both off, the supplementary feed valve 19 is on as in FIG. 3A and the pump 30 is controlled to be continuously kept on. When the pump 30 is off and the liquid surface detectors are both off, the supplementary feed valve 19 is also on while the pump 30 is controlled to be continuously kept off. That is, the third mode implies that the pump 30 is stopped only when the first liquid surface detector 42 is on.

In the present embodiment, the pump 30 and supplementary feed valve 19 are operated in any of the first to third modes as described above.

Next, the ink circulation operation of the ink path 1 according to the present embodiment will be described with reference to FIGS. 4A to 4F.

Figure 4A:
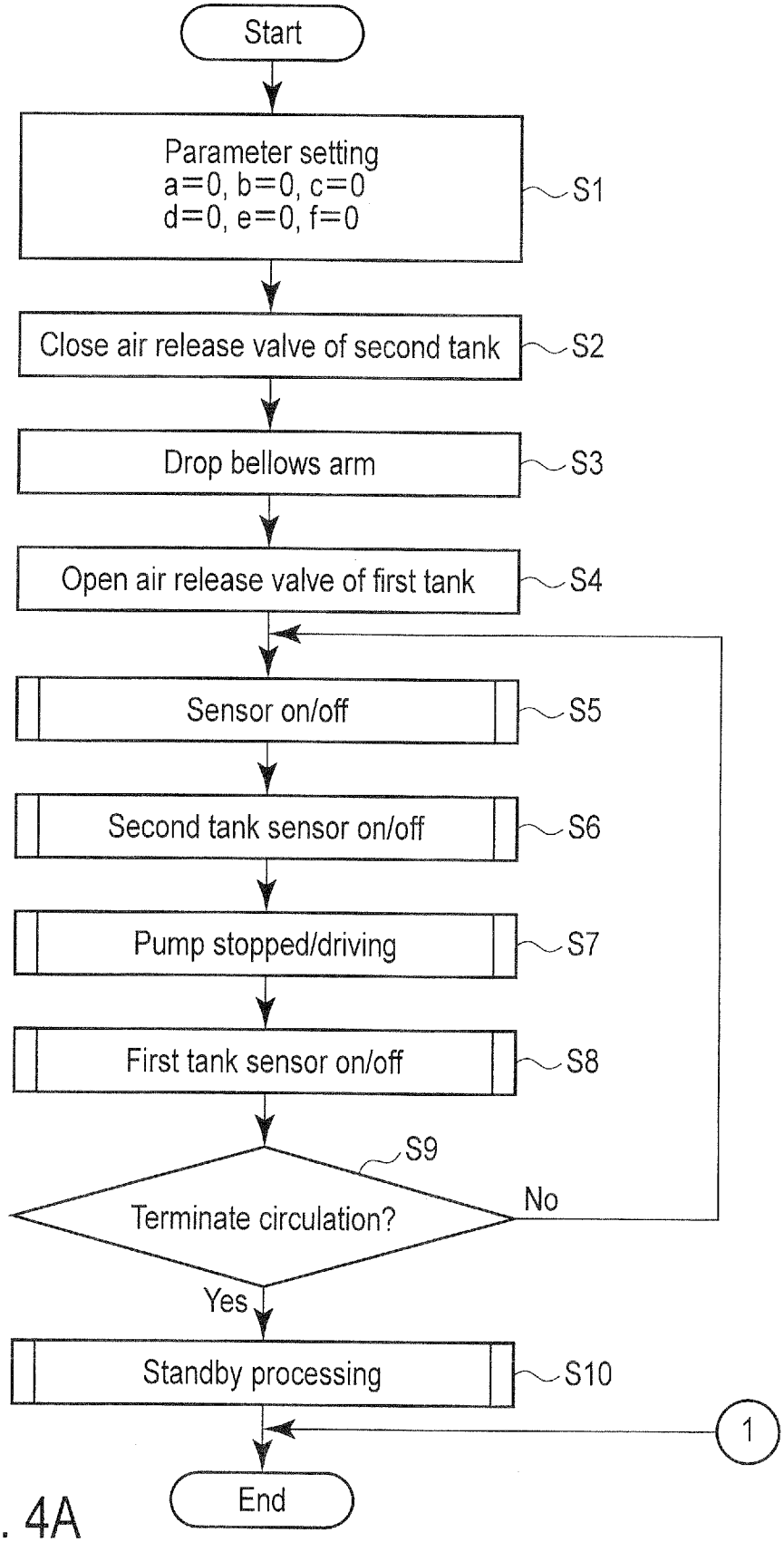
FIG. 4A is a flowchart showing a whole ink circulation operation according to the embodiment.

FIG. 4A, is a flowchart showing the whole ink circulation operation.

In the present embodiment, in an initial state (standby state) in which no ink is circulated, the supplementary feed valve 19 and the air release valve 26 for the first tank 4 are closed while the air release valve 28 for the second tank 5 is opened. In addition, the pump 30 stops.

At first, to start an ink circulation operation, six parameters a to f for the storage unit 70 are set a=0, b=0, c=0, d=0, and f=0 (step S1). Next, the air release valve 28 for the second tank 5 is closed (step S2). Next, the bellows elevation mechanism 47 of the pressure adjuster 11 is operated to move down the bellows unit 45 by the weight of the weight unit 46 (step S3). Further, the air release valve 26 of the first tank 4 is opened (step S4). Thus, a pressured state is created in the first tank 4, and a negative state is created in the second tank 5. From step S5, the ink is circulated through the ink circulation path until the ink circulation is determined to have ended, in step S9.

Figure 4B:
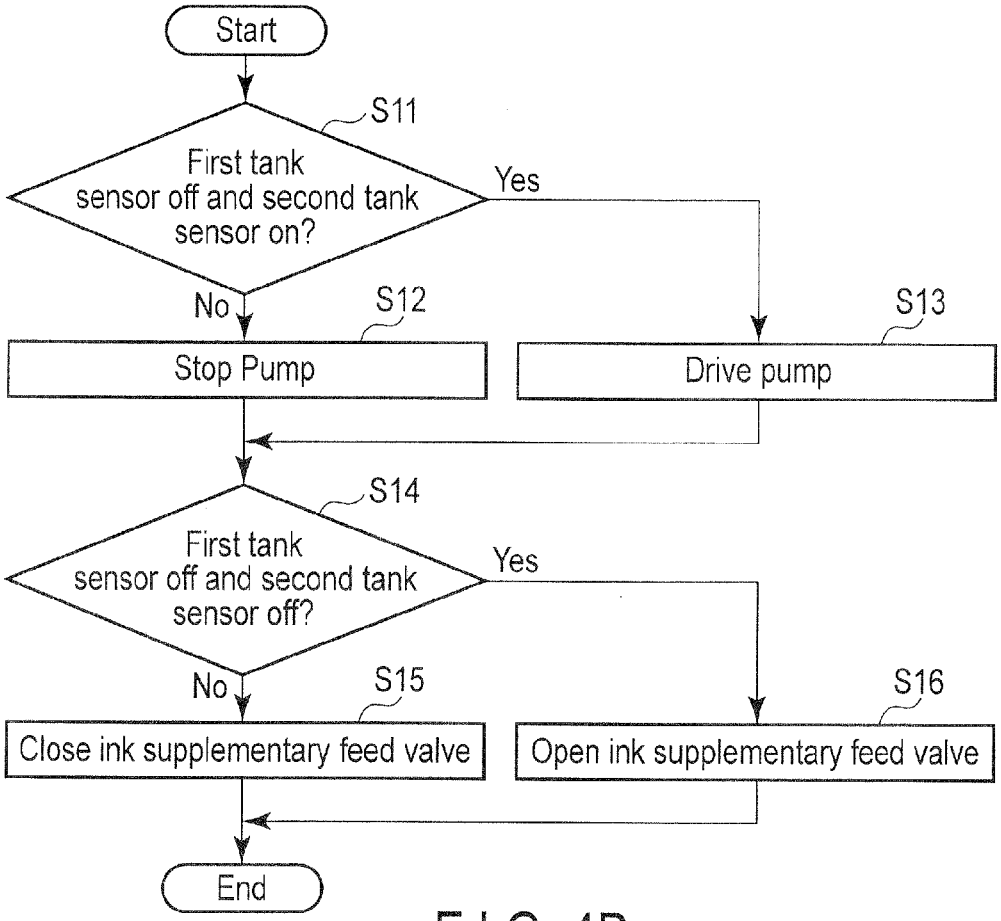
FIG. 4B is a flowchart showing a subroutine of sensor on/off for charging an ink in FIG. 4A.

After step S4, the processing transits to a subroutine to turn sensors on/off for charging an ink (step S5). FIG. 4B is a flowchart showing the subroutine to turn sensors on/off for charging an ink (steps S11 to S16).

At first, whether or not the first liquid surface detector 42 (hereinafter referred to as first sensor 42) which detects an ink liquid surface in the first tank 4 is off and the second liquid surface detector 43 which detects an ink liquid surface in the second tank 5 (hereinafter referred to as a first sensor 43) is on is determined (step S11). If not (NO) in step S11, the pump 30 is stopped (kept stopped) as in the first, second, and fourth to sixth states 61, 62, and 64 to 66 in FIGS. 3A to 3C (step S12). If so (Yes) in step S11, the pump 30 is driven (maintains driving) as in the third state 63 in FIGS. 3A to 3C (step S13). Thus, when only the ink in the first tank 4 is determined to run short of the ink, the ink in the second tank 5 is fed upward to the first tank 4 by the pump 30.

Next, whether or not the first sensor 42 and the second sensor 43 are both off is determined (step S14). If not (NO) in step S14, the supplementary valve 19 is closed (maintains closing) as shown in the first to third and fifth states 61 to 63 and in FIGS. 3A to 3C (step S15). If so (Yes) in step S14, the supplementary valve 19 is opened (maintains opening) as shown in the fourth or six state 64 or 66 in FIGS. 3A to 3C (step S16). Thus, when both of the first and second tanks 4 and 5 are determined to run short of the ink, the ink is supplied from the ink cartridge 14 through the tube 18 to the first tank 4.

Referring back to FIG. 4A, following step S5, the processing transits to a subroutine of sensor on/off (step S6) for detecting an operation of the second sensor 43. FIG. 4C is a flowchart showing a subroutine of sensor on/off (steps S17 to S24) for detecting an operation of the second sensor 43.

At first, whether or not the second sensor 43 is off is determined (step S17). If not off, i.e., if on (NO), "a" is incremented a=a+1) (step S18) and "b" is reset (b=0) (step S19). That is, in repetition of steps S5 to S9, if the processing sequentially goes to NO in step S17, "a" is incremented in step S18 and accumulatively stored in the storage unit 70. Then, whether N<a or not is determined (step S20). In this step, N is an arbitrarily set value. For example, where a looping duration from step S5 to S9 is supposed to be 100 milliseconds, N=30 is set if abnormality is determined to be occurring when an output waveform stays unchanged continuously for three seconds.

More specifically, when steps S5 to S9 are repeated, an ink which is not ejected from the nozzles of the ink heads 2 usually flows into the second tank 5 in a downstream side, or an intermittent operation of the pump 30 causes the first tank 4 to be drawn upward to the first tank 4 from the second tank 5. Therefore, the height of the liquid surface in the second tank 5 is supposed to change, and an output waveform of the second sensor 43 is also supposed to repeatedly turn on and off. Accordingly, if the output waveform of the second sensor 43 stays unchanged for the number of times N which is set by the second sensor 43 or, in other words, for a predetermined time (three seconds according to the setting described above) according to setting, an abnormality may have occurred in the second sensor 43 or may have hindered proper ink circulation operation by the abnormality. Therefore, an abnormality (operation error) is determined to be occurring.

Unless N<a (NO) in step S20, this subroutine is terminated and the processing goes to step S7. If N<a (YES), the second sensor 43 is kept on and stays unchanged for a predetermined time. Therefore, an abnormality is determined to be occurring, and the processing goes to a subroutine for a standby processing (see FIG. 4F) (step S10). Further, a service call is made to notify a user or service person of the abnormality (step S21).

The service call may be a unit for visually or aurally informing a user or service person by displaying a position where the abnormality occurs in a display not shown or by outputting an audible alert or a sound. Of course, the unit described above may be combined together. Thus, if an abnormality is determined to be occurring, the processing transits to the standby processing. Thereafter, the circulation operation can be stopped early by notifying the user of the abnormality occurring.

If the second sensor 43 is off in step S17 (YES), "b" is incremented (b=b+1) (step S22), and "a" reset (a=0) (step S23). That is, in repetition of steps S5 to S9, if the processing sequentially goes to YES in step S17, "b" is incremented in step S22 and accumulatively stored in the storage unit 70. Then, whether N<b or not is determined (step S24).

Unless N<b (NO) in step S24, this subroutine is terminated and the processing goes to step S7. If N<b (YES), the second sensor 43 is kept off and stays unchanged for a predetermined time (three seconds according to the setting described above). Therefore, an abnormality is determined to be occurring, and the processing goes to the subroutine described later for the standby processing (step S10). Further, a service call is made (step S21).

Referring back to FIG. 4A, following step S6, the processing goes to a subroutine of pump stopping/driving (step S7) for detecting an operation of the pump 30. FIG. 4D is a flowchart showing a subroutine of pump stopping/driving (steps S25 to S31) for detecting an operation of the pump 30.

At first, whether or not the pump 30 stops is determined (step S25). If not stopped, i.e., if driving (NO), "c" is incremented (c=c+1) (step S26) and d is reset (d=0) (step S27). That is, in repetition of steps S5 to S9, if the processing sequentially goes to NO in step S25, "c" is incremented in step S26 and is accumulatively stored in the storage unit 70. Then, whether N<c or not is determined (step S28).

As described above, if the ink circulation operates properly, the pump 30 operates intermittently. Unless N<c (NO) in step S28, this subroutine is terminated and the processing goes to step S8. If N<c (YES), an abnormality is determined to be occurring, and the processing goes to the subroutine for the standby processing described later (step S10). Further, a service call is made (step S21).

If the pump 30 is stopped in step S25 (YES), "d" is incremented (d=d+1) (step S29), and "c" is reset (c=0) (step S30). That is, in repetition of steps S5 to S9, if the processing sequentially goes to YES in step S25, "d" is incremented in step S29 and accumulatively stored in the storage unit 70. Then, whether N<d or not is determined (step S31).

Unless N<d (NO) in step S31, this subroutine is terminated and the processing goes to step S9. If N<d (YES), an abnormality is determined to be occurring, and the processing goes to the subroutine for the standby processing described later (step S10). Further, a service call is made (step S21).

Referring back to FIG. 4A, following step S7, the processing transits to a subroutine of sensor on/off (step S8) for detecting an operation of the first sensor 42. FIG. 4E is a flowchart showing the subroutine of sensor on/off (steps S32 to S44) for detecting an operation of the first sensor 42.

At first, whether or not the first sensor 42 is off is determined (step S32). If not off, i.e., if on (NO), "e" is incremented (e=e+1) (step S33), and "f" is reset (f=0) (step S34). That is, in repetition of steps S5 to S9, if the processing sequentially goes to NO in step S32, "c" is incremented in step S33 and is accumulatively stored in the storage unit 70. Then, whether e>T5 or not is determined (step S35). "T5" is a value which is set based on the same concept for N as described above.

Unless e>T5 (NO) in step S35, this subroutine is terminated and the processing goes to step S9. If e>T5 (YES), the first sensor 42 is kept on and stays unchanged for a predetermined time. Therefore, the processing goes to the subroutine for the standby processing described later (step S10). Further, a service call is made (step S21).

If the first sensor 42 is off in step S32 (YES), "f" is incremented (f=f+1) (step S36), and "e" is reset (a=0) (step S37). That is, in repetition of steps S5 to S9, if the processing sequentially goes to YES in step S32, "f" is incremented in step S36 and is accumulatively stored in the storage unit 70. Then, whether f<T6 or not is determined (step S38). This "T6" is a value which is also set based on the same concept for N as described above.

Unless f<T6 (NO) in step S38, this subroutine is terminated and the processing goes to step S9. If f>T6 (YES), the first sensor 42 is considered to be continuously kept off in the repetition of steps S5 to S9. With respect to it, two reasons can be considered, i.e., an abnormality occurs in the first sensor 42 itself or sufficient ink does not remain (empty) in the ink cartridge 14 as an ink supply and the first tank 4 is therefore not supplied with an ink while the first sensor 42 operates properly. Therefore, if f>T6 (YES), the processing goes to step S39 and later steps to specify which of the two reasons described above causes the first sensor 42 to be off for a predetermined time.

At first, the pump 30 is stopped (kept stopped) (step S39). Next, the supplementary feed valve 19 is closed (kept closed), and the ink supply operation is stopped (step S40). Further, whether the second sensor 43 is on or not is determined (step S41). If on (YES), the processing goes to step S43. If not on (NO), on is waited for a predetermined time (step S42). Since the pump 30 is stopped in step S39, an ink flows into the second tank 5 through the ink heads 2 from the first tank 4 after waiting for a while in step S42 and the second sensor 43 is off, even if the second sensor 43 is not on in step S41. The second sensor 43 is confirmed to be on in steps S41 and S42, in order to secure that the second tank 5 still contains an ink a predetermined amount or more.

If on (YES) step S41 or after step S42, the pump 30 is driven again (step S43). Then, the ink in the second tank 5 is fed upward to the tank 4. Further, whither or not the first sensor 42 is turned on within a time T1 is determined (step S44). This time T1 is set to a time when the first sensor 42 is always turned on if only the pump 30 is continuously driven for time T1.

If the first sensor 42 is turned on within time T1 (YES) in step S44, the first sensor 42 is determined to turn on although the first sensor 42 has been continuously determined to be off in step S32 in the repetition of steps S5 to S9. Therefore, on/off operations of the first sensor 42 are excellent. Thus, a reason for the first sensor 42 continuously determined to be off attributes to an insufficient ink remaining in the ink cartridge 14.

Further, the processing goes to the standby processing described later (step S10) and notifies that the ink cartridge 14 is empty (i.e., only insufficient ink remains in the ink cartridge 14) (step S45). This notification can be performed by displaying on a display, generating an alert, and a combination thereof, like a service call (step S21) described above.

Unless the first sensor 42 turns on within time T1 in step S44 (NO), the first sensor 42 is determined to be occurring in the first sensor 42 itself, and the processing goes to the standby processing described later (step S10). Further, a service call is made (step S21).

Referring back to FIG. 4A, following step S8, whether or not the ink circulation operation is terminated is determined (step S9). If the ink circulation operation is continued (NO), the processing returns to step S5 and repeats steps S5 to S9. If the ink circulation operation is to be terminated (YES), the processing goes to the standby processing (step S10).

Figure 4F:
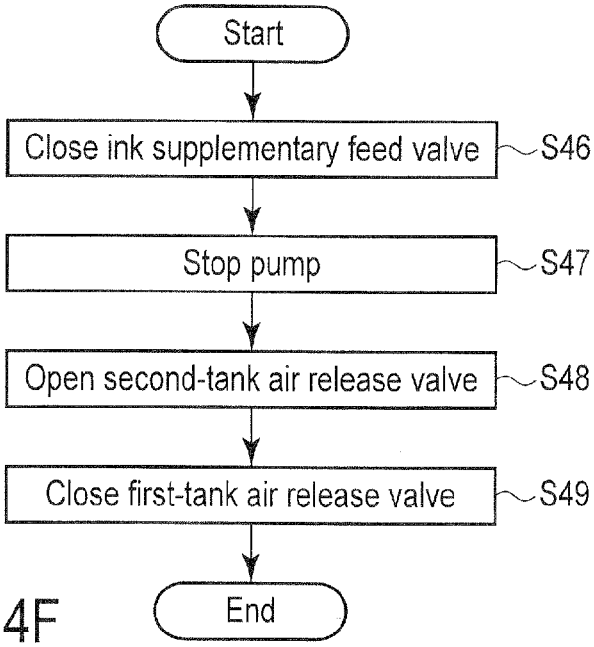
FIG. 4F is a flowchart showing a subroutine for a standby processing in FIG. 4A and FIGS. 4C to 4E.
Figure 4C:
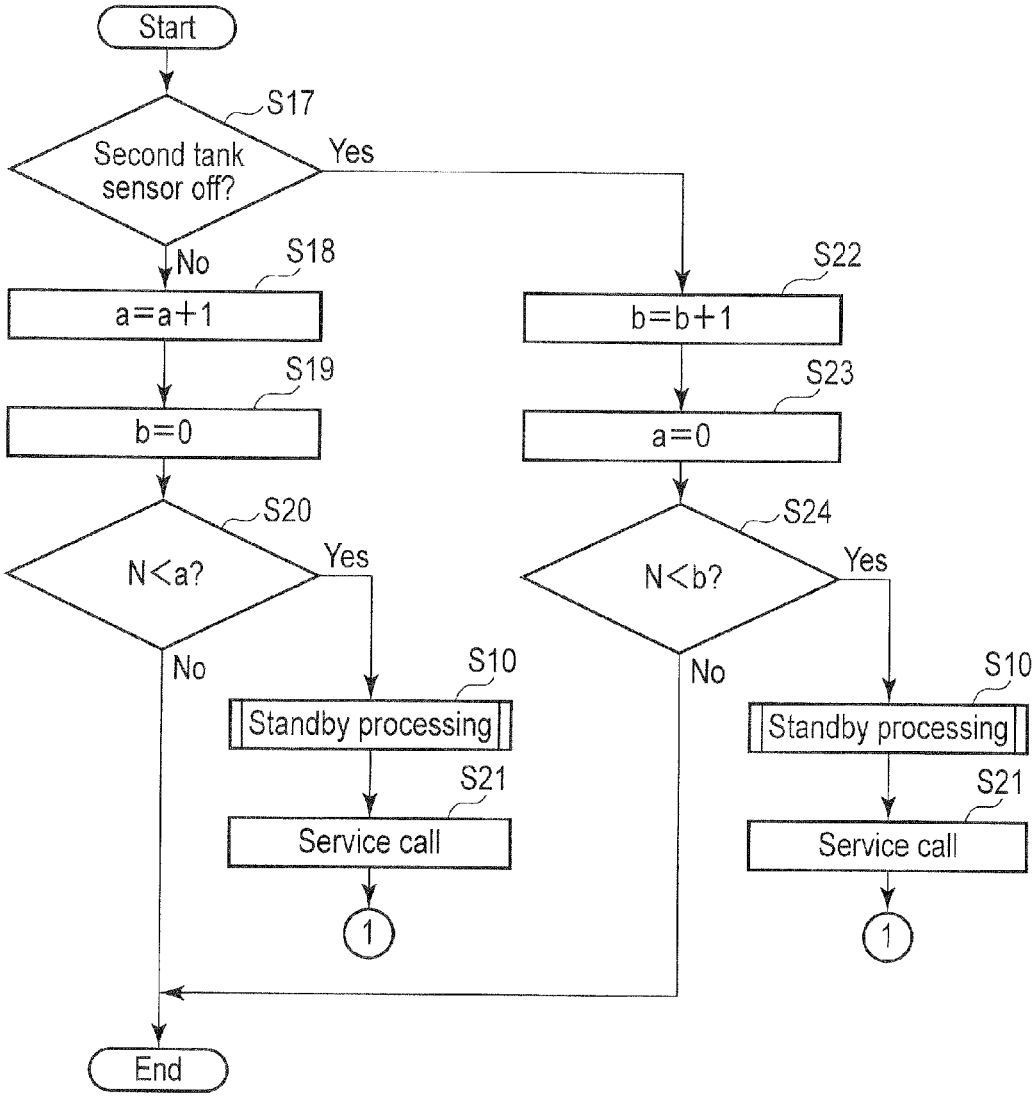
FIG. 4C is a flowchart showing a subroutine of sensor on/off for detecting an operation of a second sensor in FIG. 4A.
Figure 4D:
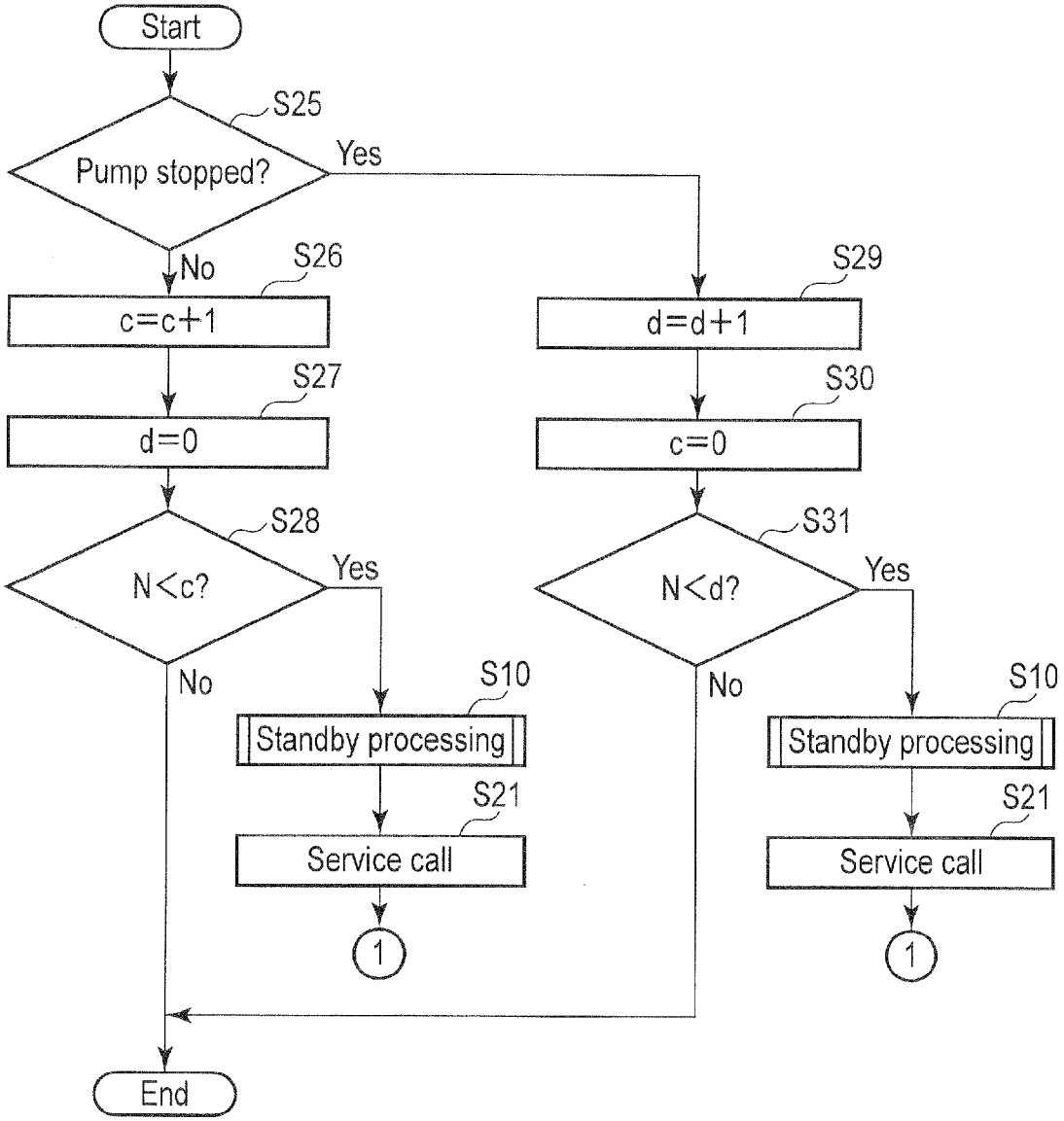
FIG. 4D is a flowchart showing a subroutine of pump stopping/driving for detecting an operation of the pump in FIG. 4A.
Figure 4E:
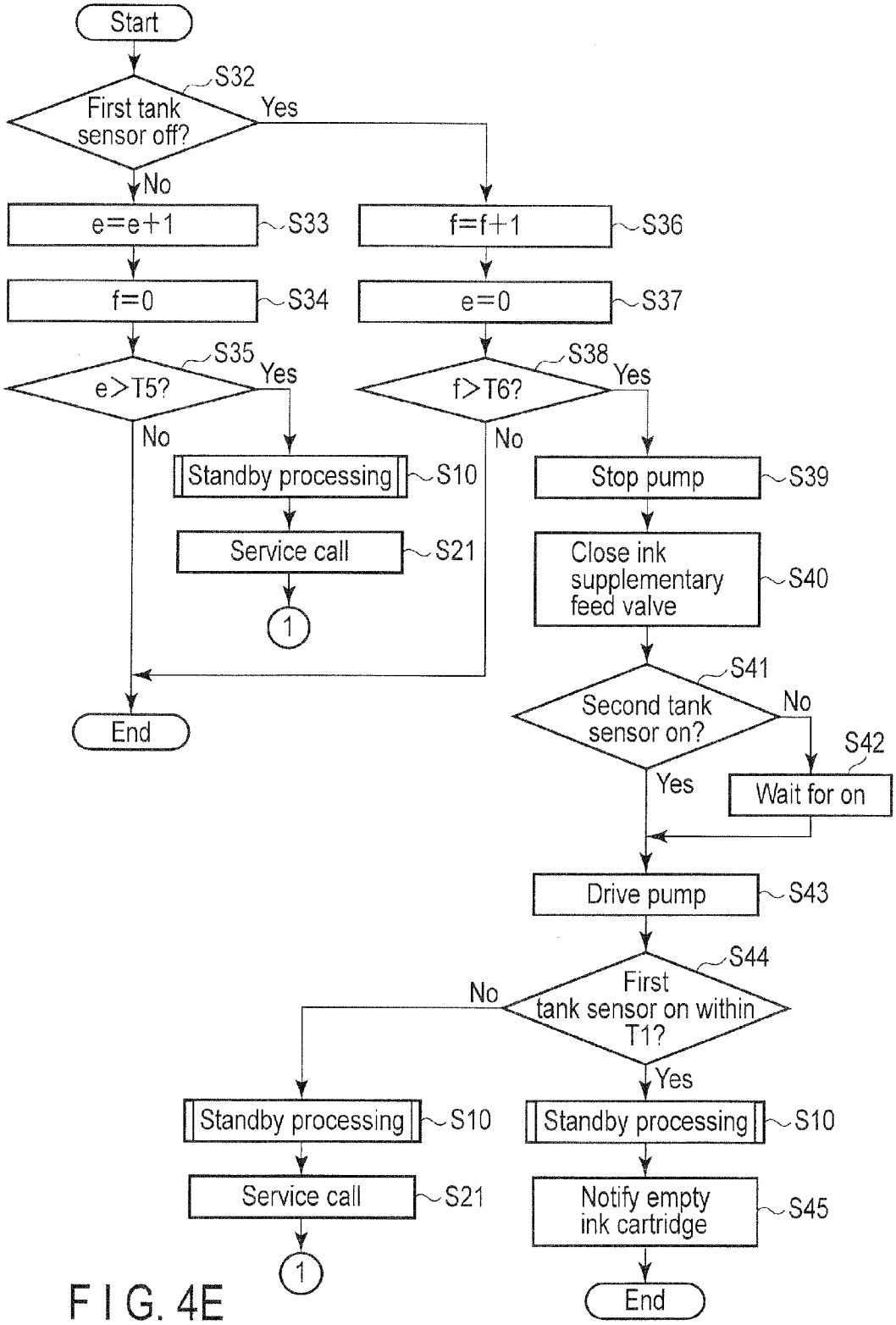
FIG. 4E is a flowchart showing a subroutine of sensor on/off for detecting an operation of a first sensor in FIG. 4A.

FIG. 4F is a flowchart showing the subroutine (steps S46 to S49) of the standby processing.

At first, the supplementary feed valve 19 is closed (kept closed) (step S46). Further, the pump 30 is stopped (kept stopped) (step S47). Next, the air release valve 28 for the second tank 5 is opened (step S48), and the air release valve 26 for the first tank 4 is closed (step S49). Thus, a standby state is created (the nozzles of the ink heads 2 are applied with a slight negative pressure).

When step S10 is terminated, the ink circulation operation then ends.

As has been described above, according to the present embodiment, an on/off output from the second liquid surface detector 43 is detected, i.e., whether or not the ink liquid surface in the second tank 5 is lower than a predetermined level is detected. Detected information thereof is accumulatively stored in the storage unit 70. Further, the determination unit 80 determines whether or not an abnormality occurs in the second liquid surface detector 43. Whether or not the on/off output of the first liquid surface detector for the first tank 4 is lower than a predetermined level, detected information thereof is accumulatively stored into the storage unit 70. Further, the determination unit 80 determines whether or riot an abnormality is occurring in the first liquid surface detector 42, in accordance with the accumulatively stored information. Thus, proper operations of the liquid surface detectors can be confirmed by monitoring liquid surface detectors which detect ink liquid surfaces in two ink tanks having a difference in height between each other, with use of a principle of a so-called watch dog timer. Accordingly, a proper ink circulation operation can be maintained.

Also in the present embodiment, an abnormality is determined to be occurring if a detection signal from the second liquid surface detector 43 is continuously kept in a state (on or off) for a predetermined time during the ink circulation operation, i.e., if the ink liquid surface in the second tank 5 continues to be not lower or to be lower than a predetermined level for a predetermined time. Further, if a detection signal from the first liquid surface detector 42 continues to be on for a predetermined time during the ink circulation operation, an abnormality is determined to be occurring. Alternatively, if the detection signal continues to be off for the predetermined time, occurrence of an abnormality is not immediately notified but the determination unit 80 determines whether the abnormality is caused by a liquid surface detector or shortage of ink in an ink cartridge. Therefore, whichever liquid surface detector causes an abnormality, occurrence of the abnormality can be detected accurately. Further, a factor which causes the abnormality can be specified, and a user or service person can easily cope with the abnormality during a maintenance service.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An inkjet printer comprising:

an ink circulation path comprising an ink head comprising a nozzle surface where a plurality of nozzles which eject an ink are formed, a first tank which is positioned above the nozzle surface along a gravitational direction and stores the ink to be supplied for the ink head, a second tank which is provided below the nozzle surface in the gravitational direction and stores the ink collected from the ink head, and a pump which pumps the ink from the second tank to the first tank;

first and second liquid surface detectors which respectively detect ink liquid surfaces in the first and second tanks;

an ink supply unit which supplies the ink circulation path with the ink;

a supplementary feed valve which makes the ink supply unit and the ink circulation path communicate with or shut from each other;

a control unit which controls driving and a stop operation of the pump, an open/close operation of the supplementary feed valve, and the whole inkjet printer;

a storage unit which stores information detected by the first and second liquid surface detectors; and a determination unit which determines whether or not an abnormality occurs in the first and second liquid surface detectors, based on the information, wherein when the ink circulates through the ink circulation path, the second liquid surface detector detects whether or not the ink liquid surface in the second tank is higher than a predetermined level, the detected information is accumulatively stored into the storage unit, the determination unit determines whether or not an abnormality occurs in the second liquid surface detector, based on the accumulatively stored information, the first liquid detector thereafter detects whether or not the ink liquid surface in the first tank is higher than a predetermined level, the detected information is accumulatively stored into the storage unit, and the determination unit determines whether or not an abnormality occurs in the first liquid surface detector, based on the accumulatively stored information.

2. The inkjet printer according to claim 1, wherein whether or not an abnormality occurs in the second liquid surface detector is determined by determination that the abnormality occurs when the accumulatively stored information of the second liquid surface detector indicates that the ink liquid surface in the second tank continues to be higher than or to be lower than the predetermined level for a predetermined time.

3. The inkjet printer according to claim 2, wherein whether or not an abnormality occurs in the first liquid surface detector is determined by the determination that the abnormality occurs when the accumulatively stored information of the first liquid surface detector indicates that the ink liquid surface in the first tank continues to be higher than or to be lower than the predetermined level for a predetermined time.

4. The inkjet printer according to claim 3, wherein if the accumulatively stored information of the first liquid surface detector is determined to indicate occurrence of the abnormality by the determination unit because the ink liquid surface in the first tank continues to be lower than the predetermined level for a predetermined time, the determination unit further determines whether the occurrence of the abnormality is caused by the abnormality in the first liquid surface detector or by shortage of the ink in the ink supply unit.

5. The inkjet printer according to claim 1, wherein whether or not an abnormality occurs in the first liquid surface detector is determined by the determination that the abnormality occurs when the accumulatively stored information of the first liquid surface detector indicates that the ink liquid surface in the first tank continues to be higher than or to be lower than the predetermined level for a predetermined time.

6. The inkjet printer according to claim 5, wherein if the accumulatively stored information of the first liquid surface detector is determined to indicate occurrence of the abnormality by the determination unit because the ink liquid surface in the first tank continues to be lower than the predetermined level for a predetermined time, the determination unit further determines whether the occurrence of the abnormality is caused by the abnormality in the first liquid surface detector or by shortage of the ink in the ink supply unit.

7. The inkjet printer according to claim 1, further comprising a notification unit which, if an abnormality is determined to be occurring in the first or second liquid surface detector, notifies of occurrence of the abnormality.

* * * * *